US008535764B2

(12) United States Patent
Branagan et al.

(10) Patent No.: US 8,535,764 B2
(45) Date of Patent: Sep. 17, 2013

(54) PROTECTIVE COATING FOR CONCRETE DELIVERY SYSTEM COMPONENTS

(75) Inventors: Daniel James Branagan, Idaho Falls, ID (US); Brian Meacham, Idaho Falls, ID (US); Michael Breitsameter, Providence, RI (US); Rickie Lane Bush, Houston, TX (US)

(73) Assignee: The NanoSteel Company, Inc., Providence, RI (US)

( * ) Notice: Subject to any disclaimer, the term of this patent is extended or adjusted under 35 U.S.C. 154(b) by 795 days.

(21) Appl. No.: 11/874,381

(22) Filed: Oct. 18, 2007

(65) Prior Publication Data

US 2008/0229700 A1 Sep. 25, 2008

Related U.S. Application Data

(60) Provisional application No. 60/830,000, filed on Oct. 18, 2006.

(51) Int. Cl.
*B05D 3/02* (2006.01)

(52) U.S. Cl.
USPC ..... 427/376.2

(58) Field of Classification Search
USPC ..... 427/376.2
See application file for complete search history.

(56) References Cited

U.S. PATENT DOCUMENTS 5,107,679 A * 4/1992 Bartlett ..... 60/481
5,184,706 A 2/1993 Christenson
5,976,274 A * 11/1999 Inoue et al. ..... 148/304
2006/0005900 A1 1/2006 Dorfman
2006/0228563 A1 10/2006 Lenges et al.

FOREIGN PATENT DOCUMENTS

RU 2201994 C1 * 4/2003
WO 2005072954 8/2005

OTHER PUBLICATIONS

The Nanosteel Company Website (http://web.archive.org/web/20041215204449/nanosteelco.com/applications.shtml, dated via internet wayback machine as available on Dec. 15, 2004) p. 1-5.*
Branagan et al "High-Performance Nanoscale Composite Coatings for Boiler Applications" Journal of Thermal Spray Technology V14 (2) Jun. 2005 p. 196-204.*
Branagan et al "Formation of Nanoscale Composite Coatings Via HVOF and Wire-Arc Spraying" International Thermal Spray Conference 2005, Basel, Switzerland, May 2-4, 2005, p. 1-14.*
SHS7170 HVOF Technical Data Sheet (from http://www.nanosteelco.com/products/tech_data_pdf/7170_hvof_tech_data.pdf; accessed Apr. 17, 2012).*
International Search Report and Written Opinion issued in International Patent Application No. PCT/US/07/81796 dated Mar. 7, 2008 (9 pages).
European Search Report dated Mar. 15, 2010 issued in related European Patent Application No. 07844404.9-2122.

* cited by examiner

*Primary Examiner* — Nathan Empie
(74) *Attorney, Agent, or Firm* — Grossman, Tucker, Perreault & Pfleger, PLLC

(57) ABSTRACT

The present invention relates to a component of a concrete delivery system comprising a substrate made of relatively thin gauge carbon steel or aluminum, and a protective coating of amorphous, nano or near-nanoscale steel, or mixtures thereof, overlying the substrate, wherein the coating may be formed by thermal deposition process from multi-component glass forming steel alloys. The protective coating may also be heat treated to increase wear life.

5 Claims, 2 Drawing Sheets

PROTECTIVE COATING FOR CONCRETE DELIVERY SYSTEM COMPONENTS

CROSS REFERENCE TO RELATED APPLICATIONS

This application claims priority to U.S. Provisional Application No. 60/830,000 filed Oct. 18, 2006.

FIELD OF THE INVENTION

The present invention relates to a component of a concrete delivery system comprising a substrate made of plain carbon steel, aluminum, magnesium, or other lightweight alloy and a protective relatively hard coating, including an amorphous, nanoscale or near nanoscale steel and mixtures or combinations thereof, deposited from a metallic alloy. The protective coating may be heat treated to increase the wear life of the component.

BACKGROUND OF THE INVENTION

In the mobile concrete delivery industry, improvements which decrease the weight and increase the life and usability of components used in the system may influence the overall productivity and profit of the enterprise. These improvements may include increasing overall payload of the mobile delivery system, increasing service life and reliability of the various components of the system, decreasing maintenance costs and reducing lifting and strain injuries suffered by those employed within the industry who must manipulate such components. Typically in such a system concrete may be delivered to a job site by way of a mobile system comprising a mobile mixer drum and various other means such as pumps, slides, chutes, extensions and other vessels, which may be utilized to transport the concrete from the discharge port of the mixer drum to the intended external placement of the concrete. The total weight burden of such a mobile delivery system while in transit on the public highways may be regulated by law and reducing the weight of delivery system components may increase the efficiency of the system by allowing an increase in the amount of the concrete payload that may be delivered in any single trip to a job site. Typically a mobile concrete delivery system may include about five or six chutes for delivery of the concrete product to its final destination and the chutes may typically be four to six feet long. Extending the wear life of such components may also increase the overall efficiency, and operating profit, of such a system. An additional benefit is the total weight reduction, which can also be beneficial directly to workers in this industry. Also, concrete residue buildup on the components of such a mobile concrete delivery system will need to be cleaned from the components every six to eight weeks through the use of pneumatic or other types of chipping tools. Eliminating or significantly reducing this concrete buildup may enhance payload capacity, eliminate downtime for costly maintenance, or greatly enhance the overall cost efficiency of the system as a whole.

Within the industry components of mobile concrete delivery systems may typically be made from plain carbon steel, such as AR-200, and may not be coated with a wear material. Typically concrete transported in mobile delivery system will adhere to such uncoated components resulting in concrete residue buildup over a period of time. Many approaches have been used to decrease the weight and/or increase the wear life of these components. However, the use of more expensive, harder steel substrates may not provide a weight reduction and may not provide an extension of component life that would justify the increased cost. While utilizing a lighter weight substrate, such as aluminum, may decrease the overall weight of the system, a light weight substrate may decrease the wear life of a component as well. Materials utilized for the components have not been useful in eliminating the concrete residue buildup. Thus, there may be an ongoing need for improvements in maintenance intervals and to the weight and wear life of mobile concrete delivery system components.

SUMMARY OF THE INVENTION

An exemplary embodiment relates to a concrete delivery system comprising a substrate for a concrete delivery component having a surface comprising a metal/metal alloy. The surface may include a protective coating overlying a portion of the surface comprising a multi-component metal alloy having a critical cooling rate for metallic glass formation. At least a portion of the alloy may have structural unit sizes in the range of one or more of the following: about 5 Angstroms to 100 Angstroms, about 10 to 150 nm, or about 150 to 1,000 nm.

Another exemplary embodiment relates to a method of coating a concrete delivery component. The method may include providing a substrate for a concrete delivery component having a surface and depositing a multi-component alloy having a critical cooling rate for metallic glass formation onto at least a portion of the substrate to form a protective coating.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION OF THE INVENTION

Figure 1:
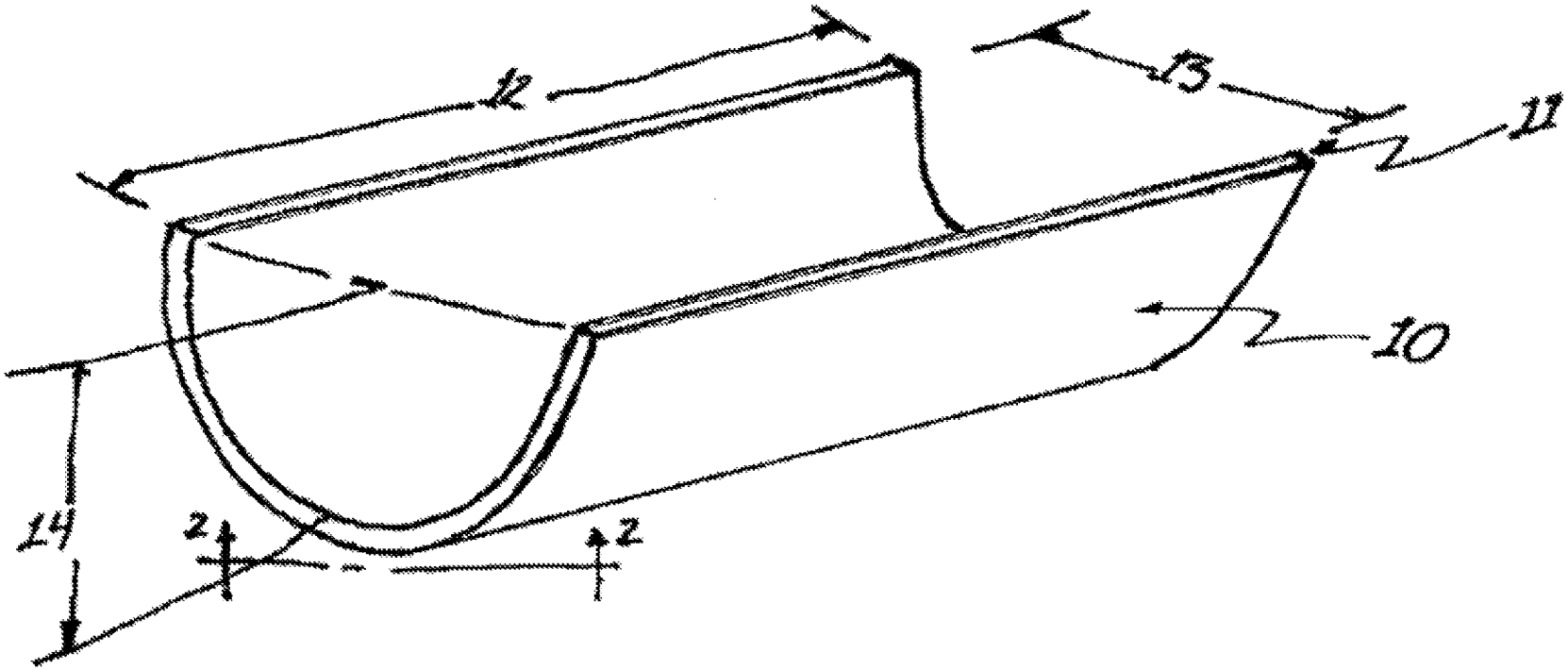
FIG. 1 is a perspective of a mobile concrete delivery system component.

The present invention relates to forming a protective overlay coating on components of a concrete delivery system exposed to high wear and residue buildup from the flow of abrasive concrete mix, such as in a concrete mixer drum or a delivery chute. More particularly, the coating may be formed by depositing a hard particle coating or a multi-component glass forming alloy using a thermal deposition process to form an amorphous, nanoscale or near nanoscale coating or a coating including combinations thereof. It should be appreciated that an amorphous coating may include structural associations or units that may be randomly packed within the alloy matrix having a size in the range of 5 to 100 Angstroms, including all values and increments therein. The nanoscale coatings may include structural associations in the range of 10 to 150 nm, including all values and increments therein, and the near nanoscale coatings may include structural associations in the range of 150 nm to 1000 nm, including all values and increments therein.

The coating so formed may be relatively more resistant to residue buildup and to wear than the substrate, thus extending the life of such components. Additionally, components coated with such hard particle coating or glass forming alloys may utilize relatively thinner gauge steel substrates or substrates made from relatively less dense materials, such as aluminum, thereby reducing the weight of the component and increasing the payload of the overall concrete delivery system. Thin gauge steel or lightweight substrates such as aluminum or magnesium may not typically be used for components in concrete delivery systems since the wear rate may be unacceptably high and the service life of those components may, therefore, be uneconomically short. The invention thus provides an improved concrete delivery system component that may be lighter and may provide better wear and buildup protection from the concrete mix utilized in these systems. The concrete delivery system may be a mobile system such as a concrete mixing vehicle.

As used herein the term "thermal deposition" refers to a metallic material that has been applied to a substrate in an at least partially molten state. Furthermore, the term thermal deposition contemplates an interface between the metallic material and the substrate that exhibits strong bond strength of approximately 5,000 to 10,000 psi or greater, or a fused interface such that there is at least partial metallic bonding between the metallic material and the substrate. Accordingly, a thermal deposition process or system may include, but is not limited to, metallic material applied in a welding process; a thermal spray (including arc wire, HVOF, combustion, or plasma) metal coating, in which a molten or semi-molten metal is sprayed onto a substrate. A hard particle coating matrix system may be utilized in any of the foregoing whereby hard particles are added during manufacturing (such as WC/Co), precipitated out during the thermal cycle (carbides or borides) or produced during an oxidation process (such as WC, CrC, TiC, NbC, CrO, AlO, TiO or other carbides or borides). Accordingly, the particles included in the matrix may include complex carbides, oxides or borides or combinations thereof, which may generally include a transition metal or metalloid. The coating may also include a fused coating in which the deposited metallic coating may be heated and fused to the substrate. Various other coating types and methods may be understood in which a metallic material is at least partially fused to a substrate from a molten or semi-molten state thereby forming metallurgical bonds with the substrate. In addition the thermal deposition process may have a critical cooling rate greater than that of the coating alloy, thereby forming a metallic glass upon deposition. It should be appreciated however, that where the critical cooling rate of the deposition process may be less than that of the alloy, the deposited coating may include nanoscale or near nanoscale sized crystalline grains.

The coatings may also be at least partially devitrified after being deposited onto the substrate. Partial devitrification may lead the formation of nanoscale or near nanoscale sized crystalline grains in the coating material. The coatings may be devitrified, for example, by a heat treating process.

The present invention recognizes that glass forming steel alloys may be classified as metal/metalloid glasses. The alloy chemistries may include multi-component chemistries, such as chemistries that may be considered steels or steel alloys. A steel alloy may be understood as an alloy wherein the primary constituent (e.g. greater than 50% by weight) may be iron. In addition, the alloys may be glass forming and may have critical cooling rates for metallic glass formation less than $10^5$ K/s, such as between $10^2$ K/s to $10^4$ K/s.

In addition to iron, an additional 3 to 30 elements may be used as alloy additions in glass forming steel alloys, including all ranges and values therein, such as less than 11 elements (including the iron). The alloy chemistry may include relatively high concentrations of P-group elements, which are non-metallic and may therefore not be able to form metallic bonds. They may generally include a binary eutectic chemistry consisting of iron plus boron, carbon, silicon, phosphorous and/or gallium. Other alloy additions may include transition metals such as chromium, molybdenum, tungsten, tantalum, vanadium, niobium, manganese, nickel, copper, aluminum, and cobalt; and rare earth elements including yttrium, scandium, and the lanthanides. In one exemplary embodiment, the alloy may include Fe, Cr, Mo, W, Mn, B, Si and C, alone or in addition to other elements. The melting points of the multi-component alloys may be lower than those of conventional commercial steel alloys and may be in the range of about 800° C. to 1500° C., including all increments and values therein, such as 960° C. to 1375° C., 1100° C., etc. The phases formed during solidification may depend on alloy chemistry, processing conditions and thermal history during processing.

Exemplary alloys may specifically contain ductile phases like α-Fe and/or γ-Fe along with complex carbide, complex boride, and/or complex borocarbide phases, wherein the carbide, boride and complex borocarbide phases may include any transition metal. As noted above, a metallic glass may exhibit microstructural refinement all the way from the angstrom scale range (i.e. 5 to 100 A) if a metallic glass if formed, or the nanoscale range (i.e. 10 to 150 nm) or "near nanoscale" range (i.e. 150 to 1,000 nm) if crystallization is initiated in the metallic glass. Combinations of the ranges may be present within the alloy. Expanding upon this feature, 50% or greater by volume (vol.) of any given range may be present in the alloy. For example, the alloy may include 50% by vol. or greater of near-nanoscale structural units. The alloy may also contain 50% by vol. or less of angstrom or nanoscale structural units, including all values and ranges therein.

It should be appreciated that the level of refinement or microstructural scale of the structural units may be determined by various forms of X-ray diffraction with Scherrer analysis to analyze peak broadening, electron microscopy (either scanning electron microscopy or transmission electron microscopy) or Kerr Microscopy utilizing a confocal scanning microscope. For example, scanning electron microscopy (SEM) may be used to produce an electron backscattered diffraction image, by detecting backscattered electrons which may detect the contrast between areas with different chemical compositions. Such an image may be used to determine the crystallographic structure of a specimen. In addition, SEM electron diffraction may be utilized. While the spatial resolution of an SEM may depend on the size of the beam, the resolution may also be dependent on the interaction volume, or the extent of material which may interact with the electron beam. In such a manner, the resolution may be in the range of about 1 to 20 nm.

Transmission electron microscopy (TEM) may also be used to measure the microstructural units using techniques such as selected area diffraction, convergent beam diffraction and observation with or without rocking the beam. As it may be difficult to see the short range order/extended short range order arising from molecular associations due to the extremely fine ordering in metallic glasses, advanced TEM techniques may be used. Dark field transmission electron microscopy may be utilized as well as high resolution transmission electron microscopy or field emission transmission electron microscopy. Furthermore, scanning transmission electron microscope may be used with aberration correction software to produce images on the sub-Angstrom scale.

Magnetic techniques such as direct measurements of domains using a confocal scanning Kerr microscope may be employed to measure domain size as well. Further measurements may also include indirect measurements of nearest neighbor associations leading to magnetic moments, Curie Temperature, and saturation magnetization.

The properties and/or combination of properties found in the amorphous, nanoscale or near nanoscale alloy coating produced may be outside the existing boundaries of conventional coatings or outside the boundaries of the underlying substrate materials which make up the substrates to be coated and may include extremely high hardness, extremely high bond strength, superior wear enhancement, and enhanced corrosion resistance.

When applied by thermal spray application, the coatings may exhibit relatively high bond strength, signifying that the multi-component glass forming alloys may have relatively high adhesion and cohesion when forming a coating. The relatively high adhesion values highlight the relatively low residual stress (even at high thickness) that is an inherent factor in coatings of this type. The relatively high cohesion values may also mean that the probability of "pull-out" of individual particles during service under wear, erosion and other conditions may be relatively low.

The relatively high adhesion value may allow these coatings to be sprayed onto a wide variety of substrates including plain carbon steels and also onto normally difficult to coat substrates such as aluminum, magnesium, copper, and stainless steels, typically used in components for mobile concrete delivery systems, using conventional substrate preparation practices and spraying directly onto the substrate, as these coatings may not need a bond coat to achieve their relatively high bond strength. Even when sprayed at a high thickness of 40 mil, bond strength up to glue failure at 13,000 psi during ASTM C633-01 bond-pull testing may be possible on plain carbon steel, stainless steel, and aluminum alloys. In such a manner, as used herein mobile concrete delivery "component" may include, but not be limited to mixer drums and various other means such as pumps, slides, chutes, extensions and other vessels of varying dimensions, which may be utilized to transport the concrete from the discharge port of the mixer drum to the intended external placement of the concrete.

When applied by thermal spray application, the coatings may also exhibit a relatively strong "non-stick" characteristic such that concrete residue may not adhere or accumulate in significant quantities on the components of the system, facilitating easy clean up with water spray facilitating increased concrete payloads and decreased maintenance intervals.

The substrate may have a thickness of 50 mils to 250 mils, including all value and increments therein. In addition the substrate may have a density in the range of about 2.50 grams per cubic centimeter to about 10.00 grams per cubic centimeter, including all values and increments therein. For example, certain carbon steels may have a density of about 7.85 grams per cubic centimeter and certain aluminum alloys may have a density in the range of about 2.50 grams per cubic centimeter.

The contemplated macrohardness for such a coating with a thickness adequate for such testing may be in the approximate range of Rockwell C 64 to 80, including all values and increments therein. These coatings may be 3 to 4 times as harder than the AR-200 typically used as a substrate in a mobile concrete delivery system and, therefore, by utilizing a standard test method, designated as ASTM G75-01, a calculation of the wear rate of the AR-200 may be made against an equivalent measure of the coating. From the results of the G75 test data it has been determined that a typical AR-200 substrate thickness of 187 mils in a major mobile system component may be reduced to 135 mils (significantly reducing weight), when coated with about 17 to 20 mils of the multi-component alloy, and retain or increase the wear life of the component. It should be appreciated that the coating thickness may be between 5 mils to 40 mils, including all values and increments therein, such as 12 to 25 mils, etc.

The microhardness (HV100) (kg/mm$^3$) of the coatings as deposited onto the substrate may be in the range of about 850 to 1350. A portion of the coatings, however may be heat treated wherein the coating may develop a microhardness (HV100) (kg/mm$^3$) in the range of about 1200 to 1450. The heat treatment may occur at a temperature of about 400° C. to about 800° C. in the range of 5 minutes to 2 hours.

The present invention may be generally applicable to components of a mobile concrete delivery system that may operate in a high wear environment. Such components may include concrete delivery chutes such as the example shown in FIG. 1. The chute 10 may range in length 12 from approximately two feet in length to about six feet in length, including all values and increments therein, with a diameter 13 ranging from approximately 13 inches to more than 18 inches, including all values and increments there, and trough depths 14 typically ranging from 6 inches to more than one foot, including all values and increments therein. The thickness of the chute 11 may range from about 100 mils to about 200 mils, including all ranges and increments therein depending on the substrate material.

Figure 2:
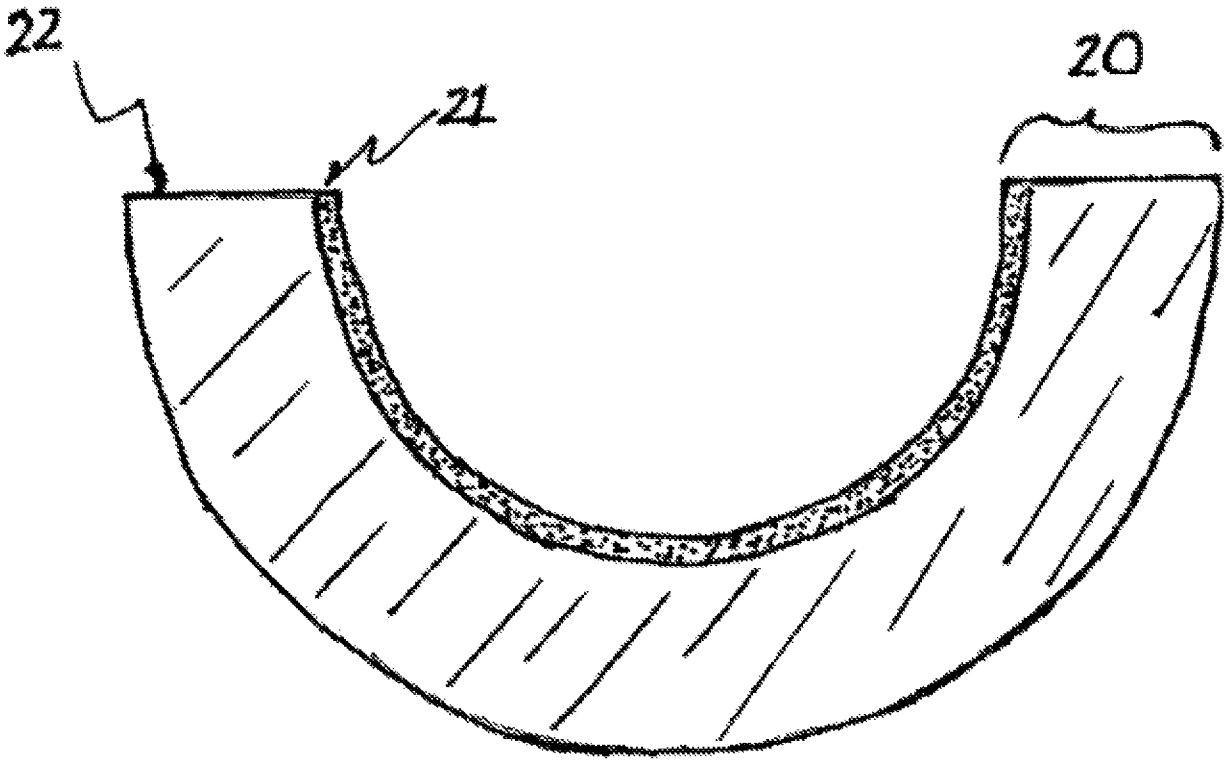
FIG. 2 is a sectional view through the component of FIG. 1 along line 2-2 showing one embodiment of the invention.

FIG. 2 illustrates an exemplary protective coating system 20. Coating system 20 may include a layer 21 of a glass forming metallic bonded to the component substrate 22 which may serve as a wear protection coating for the substrate 22. The substrate of this invention may typically be a low weight material, such as aluminum or thin gauge steel.

EXAMPLE

The example presented herein is for illustrative purposes only and is not meant to limit the scope of the invention.

Layers of a multi-component glass forming alloys, that may include Fe, Cr, Mo, W, Mn, Si, B, C, and combinations thereof are sequentially deposited by thermal spray onto a substrate of aluminum, having a density of approximately 2.71 g/cm$^3$ (rather than the typically used plain carbon steel with density of about 7.85 g/cm$^3$) and which has previously been formed into a chute component of a mobile concrete delivery system. A six foot section of such a chute component fabricated from plain carbon steel would weigh about 93 pounds while a six foot section of a chute fabricated from aluminum and coated would weigh about 20 to 25 pounds. Based on wear data generated from the ASTMG75-01 standard test, such an aluminum chute with about 10 mils of coating will provide a service wear life approximately twice as long or longer than a plain carbon steel chute of the same dimensions. One benefit may include the savings in injury/lost manpower from consecutive shifts of moving the 93 lb chutes versus the lightweight 20 to 25 lb ones. Another benefit of the coated component may be the reduction of concrete residue buildup and maintenance needed on the component.

The foregoing description is provided to illustrate and explain the present invention. However, the description hereinabove should not be considered to limit the scope of the invention set forth in the claims appended here to.

What is claimed is:

1. A method of coating a concrete delivery component comprising:

providing a substrate comprising aluminum, for a concrete delivery component having a surface;

providing a multi-component alloy comprising more than 50% by weight Fe plus Cr, Mo, W, Mn, Si, B and C having a critical cooling rate for metallic glass formation of less than $10^5$K/s and a melting point in the range of 800° C. to 1500° C.; and thermally depositing said multi-component alloy onto at least a portion of said substrate to form a protective coating, wherein said protective coating includes α- Fe and γ- Fe phases along with combinations of carbides, oxides and borides and is a metallic glass wherein at least a portion of said alloy has a combination of structural association sizes according to the following: (i) 5 to 100 Angstroms, (ii) 10 to 150 nm, and (iii) 150 nm to 1000 nm wherein said size range of 150 nm to 1000 nm is present at a level of at least 50% by volume of said protective coating, said coating has a hardness of 64 to 80 Rockwell C, and the interface between said substrate and said multi-component alloy exhibits a bond strength in the range of 5,000 to 10,000 psi.

2. The method of claim 1 further comprising:

devitrifying at least a portion of said protective coating.

3. The method of claim 2 wherein said devitrification comprises:

heating said protective coating and said substrate at a temperature of about 400° C. to about 800° C. in the range of 5 minutes to 2 hours.

4. The method of claim 1 wherein said substrate comprises a chute.

5. The method of claim 1 wherein said substrate comprises a mixing drum.

* * * * *